US005158473A

United States Patent [19]

Takahashi et al.

[11] Patent Number: 5,158,473

[45] Date of Patent: Oct. 27, 1992

[54] CONNECTOR

[75] Inventors: Akira Takahashi; Teruo Nanmoku, both of Yokohama, Japan

[73] Assignee: Matsuhita Electric Industrial Co., Ltd., Osaka, Japan

[21] Appl. No.: 718,368

[22] Filed: Jun. 20, 1991

[30] Foreign Application Priority Data

Jun. 25, 1990 [JP] Japan ..... 2-167249

[51] Int. Cl.[5] ..... H01R 13/627

[52] U.S. Cl. ..... 439/353; 439/489; 439/269

[58] Field of Search ..... 439/353, 345, 357, 350, 439/488, 358, 489, 266, 270, 490, 269

[56] References Cited

U.S. PATENT DOCUMENTS

| | | | |
|---|---|---|---|
| 1,404,098 | 1/1922 | Dennis | 439/270 X |
| 1,939,259 | 12/1933 | Good | 439/266 X |
| 3,566,336 | 2/1971 | Johnson et al. | 439/353 |
| 4,878,853 | 11/1989 | Yamade et al. | 439/490 X |
| 4,900,267 | 2/1990 | Nagasaka et al. | 439/489 |
| 4,915,649 | 4/1990 | Shimazu et al. | 439/489 X |
| 5,021,002 | 6/1991 | Noschese | 439/357 X |
| 5,034,727 | 7/1991 | Muraoka | 439/490 X |

FOREIGN PATENT DOCUMENTS

| | | |
|---|---|---|
| 1392573 | 4/1975 | United Kingdom . |
| 2239989 | 7/1991 | United Kingdom . |

*Primary Examiner*—Neil Abrams
*Assistant Examiner*—Kheim Nguyen
*Attorney, Agent, or Firm*—Stevens, Davis, Miller & Mosher

[57] ABSTRACT

A connector includes a connector section having electrical terminals disposed on each of a plug and a socket, with electrical signals being transmitted through the electrical terminals when the plug and the socket are connected to each other. A first pair of metallic pieces is disposed on the plug and a second pair of metallic pieces is disposed on the socket. A connecting section electrically connects either the first pair of metallic pieces to one another or the second pair of metallic pieces to one another, and engagement sections disposed on each of the first metallic pieces and each of the second metallic pieces lockingly connect the first metallic pieces to respective ones of the second metallic pieces to lock the plug and socket together. Selected ones of the metalic pieces may be pushed from outside the plug or the socket to release the locked state of the plug and socket.

4 Claims, 2 Drawing Sheets

CONNECTOR

BACKGROUND OF THE INVENTION

1. Field of the Invention

The present invention relates to a connector for use with an electric appliance or the like.

2. Description of the Related Art

In the prior art, connectors of this type have a locking mechanism consisting of a combination of a plug and a socket which can be joined in a locked state, and a detection mechanism for detecting the state in which they are connected.

The above-mentioned conventional connector will now be explained with reference to the accompanying drawings. FIG. 2 is a schematic perspective view showing a conventional connector.

In FIG. 2, reference numeral 21 denotes a plug; and reference numeral 22 denotes a socket. A hole 24 is formed on both sides of a connecting section 23 of a plug 21. An engagement section 25 comprising a pawl and the like is protuberantly supported on the hole 24. A pushbutton 28 is protuberantly supported on a hole 27 formed on both sides of the intermediate section of a case 26 of the plug 21. The engagement section 25 and the pushbutton 28 are connected to each other by means of a connecting plate 29 having a spring property. The engagement section 25 is made to project outwardly of the hole 24 in a state in which the pushbutton 28 is released. The engagement section 25 enters the hole 24 when the pushbutton 28 is pressed. A pin 30 is formed and projected from the case 26 on the same side as the connecting section 23. An engagement section 33 consisting of a recess, a hole, or the like, which is capable of engaging with the engagement section 25 of the plug 21, is formed on both sides of the connecting section 32 provided inside the case 31 of the socket 22. A hole 34 is formed on one side of the connecting section 32. A switch 35 is disposed in the innermost section of the hole 34.

The operation of the above construction will now be explained.

By pressing the connecting section 23 of the plug 21 into the connecting section 32 of the socket 22, the engagement section 25 is engaged with the engagement section 33 by elastic deformation of the connecting plate 29 so that the plug 21 can be inserted into the socket 22 and locked. At this time, by activating the switch 35 on the socket 22 by means of the pin 30 of the plug 21, it is detected that the plug 21 is connected to the socket 22. Thus, an electric circuit or the like can be controlled. Also, the pushbutton 28 on the plug 21 may be pressed so as to detach from the engagement section 33 on the socket 22. The engagement section 25 retreats into the hole 24, with the result that the locked state is released and the connecting section 23 of the plug 21 can be removed from the connecting section 32 of the socket 22.

With the construction of the above-mentioned prior art, however, since the detection mechanism for detecting the connection between the plug 21 and the socket 22, consisting of the pin 30, the switch 35, and the like, are added in addition to the locking mechanism between the plug 21 and the socket 22, consisting of the engagement sections 25 and 33, and the like, problems arise in that the apparatus is bulky and production costs greater.

SUMMARY OF THE INVENTION

The present invention has been devised to solve the above-mentioned problems. It is accordingly an object of the present invention to provide a connector which is small in size and low in cost by making the connector serve a double purpose of a locking mechanism and a detection mechanism for connection.

To this end, according to the present invention, there is provided a connector in which a pair of metallic plates are disposed in both a plug and a socket; engagement means are provided in such a manner as to make an engagement between these metallic plates when the plug and the socket are connected to each other so as to lock the plug and the socket; and the metallic plates of the plug and socket are electrically connected when they are locked.

Therefore, according to the present invention, when the plug and the socket are connected to each other, engagement means can make an engagement between the metallic plates of the plug and those of the socket and lock the plug and socket together, and the metallic plates can be electrically connected. One of the metallic plates is grounded to the earth and the other is connected to a connection detecting circuit in such a manner that a closed circuit is formed in this state. As a result, when the plug is connected to the socket and a closed circuit is formed, grounding and the connection detecting circuit are short-circuited. Thus the connection can be detected.

These and other objects, features and advantages of the present invention will become clear when reference is made to the following description of the preferred embodiments of the present invention, together with reference to the accompanying drawings.

DESCRIPTION OF THE PREFERRED EMBODIMENTS

Figure 1:
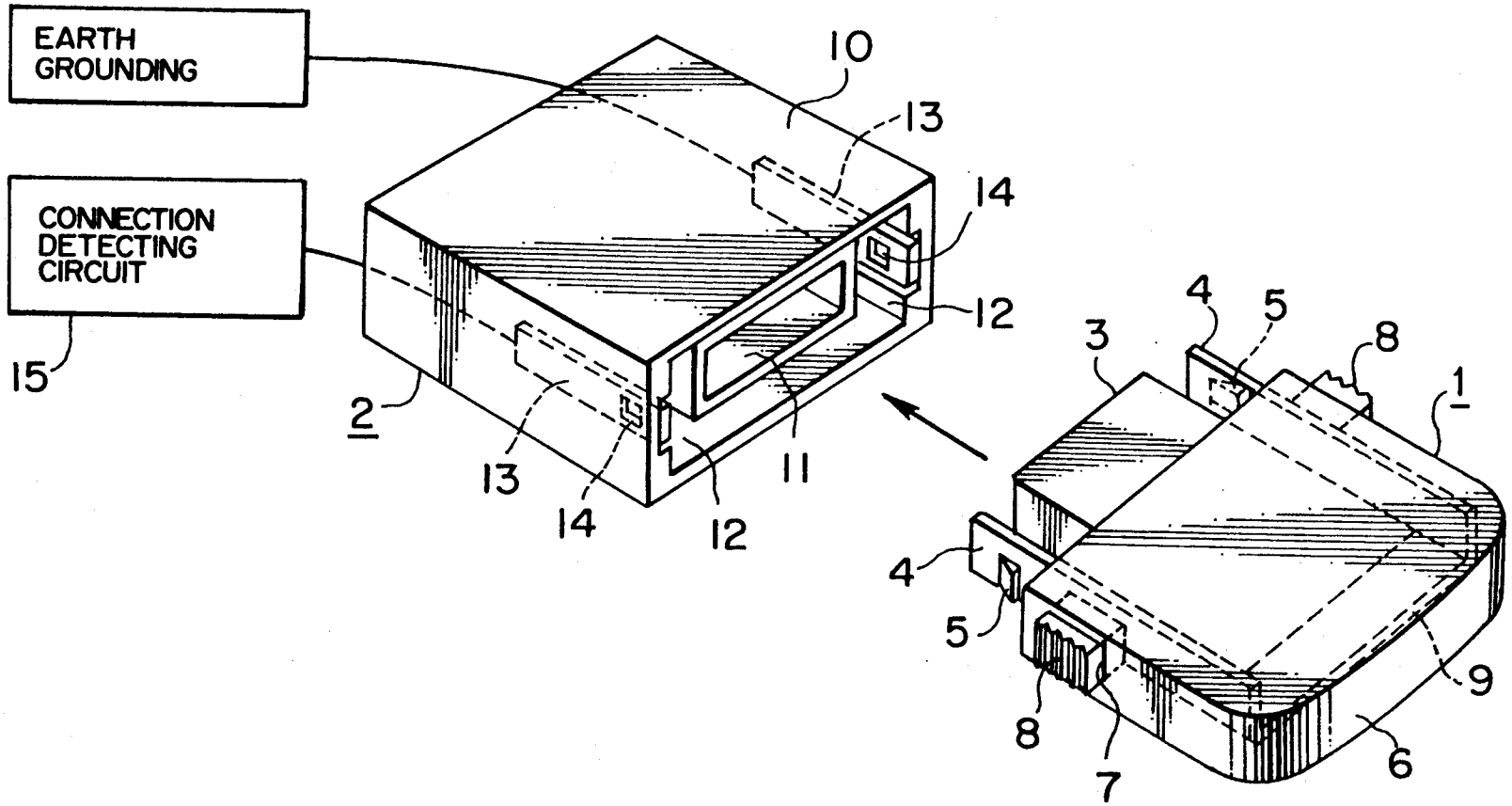
FIG. 1 is a schematic perspective view showing a connector of an embodiment of the present invention.
Figure 2:
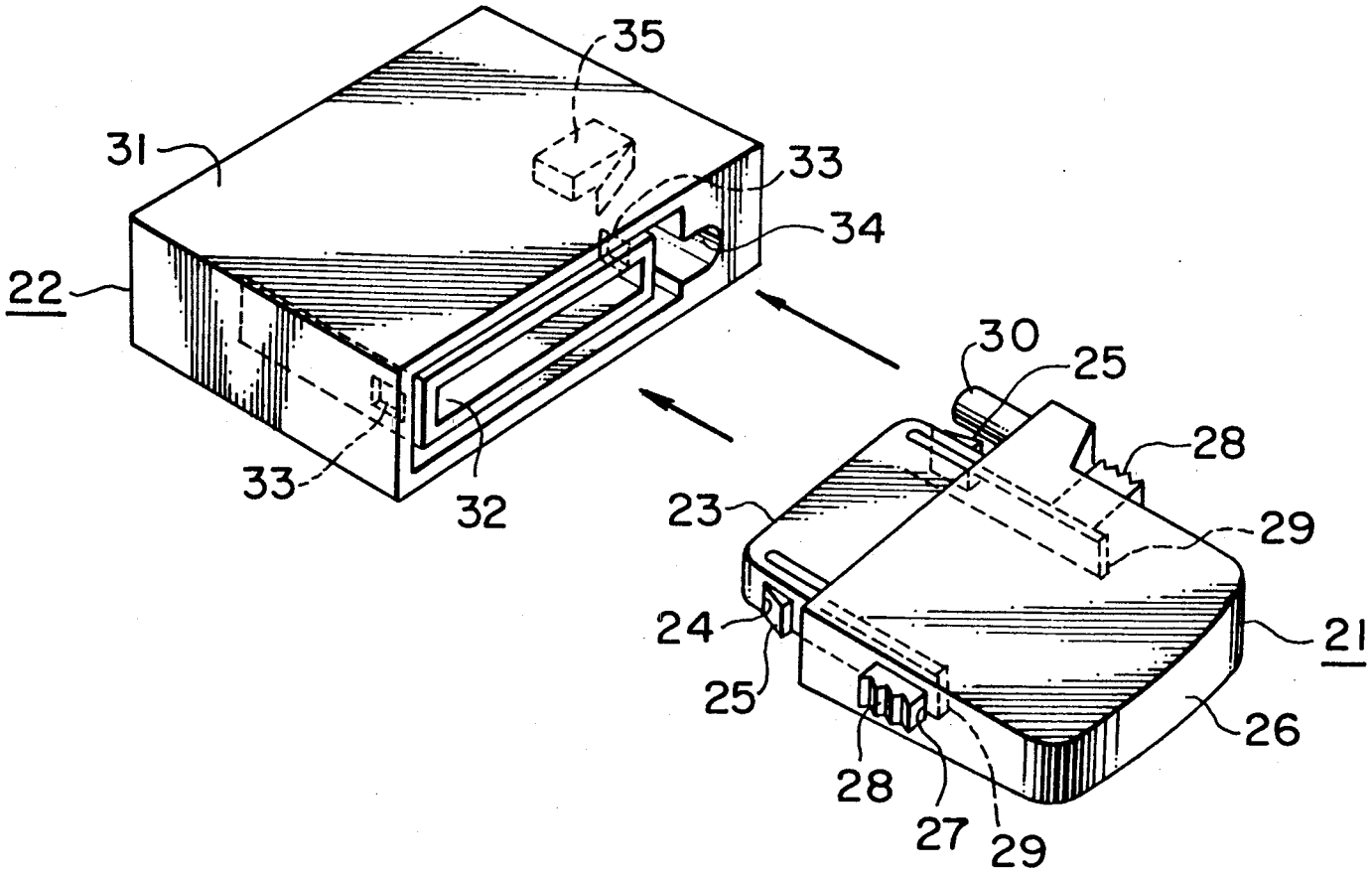
FIG. 2 PRIOR ART
FIG. 2 is a schematic perspective view showing an conventional connector.

An embodiment of the present invention will be explained below with reference to the accompanying drawings. FIG. 1 is a schematic perspective view showing a connector of an embodiment of the present invention.

In FIG. 1, reference numeral 1 denotes a plug, and reference numeral 2 denotes a socket. A metallic plate 4 having a spring property is disposed on both sides of a connecting section 3 of the plug 1. An engagement section 5 comprising a pawl and the like is projected in one piece on the exterior side of the projection section on the front side of the metallic pieces 4. A pushbutton 8 is protuberantly supported on holes 7 formed on both sides of the front section of a case 6 of the plug 1. This pushbutton 8 is connected to the intermediate section of the metallic plate 4. The front-side section of the metallic plate 4 can be bent inwardly by pressing the pushbutton 8, and the metallic plate 4 can be elastically restored by releasing the pushbutton 8. The metallic plates 4 on both sides are electrically connected by means of a plate-like connecting section 9 (or a wire-like member) inside the case 6. In the case 10 of the socket 2, a metallic plate 13 is mounted in the hole 12 on both sides of a connecting section 11, and an engagement section 14 consisting of a hole, which is capable of engaging with the engagement section 5 of the plug 1, is formed on each of the metallic plates 13. One of the metallic plates 13 in the socket 2 is grounded to the earth and the other metallic plate 13 is connected to a connection detecting circuit 15.

The operation of the above construction will now be explained.

The connecting section 3 of the plug 1 is inserted into the connecting section 11 of the socket 2, and the front side of the metallic plate 4 is pressed into the hole 12. As a result, the engagement section 5 is engaged with the engagement section 14 of the metallic plate 13 by using the elastic deformation of the metallic plate 4 so that the plug 1 can be connected to the socket 2 in a locked state. As a result, the metallic plates 4 and 4 on the plug 1 side and the metallic plates 13 and 13 on the socket 2 side are electrically brought into contact with each other. Since the metallic plates 4 and 4 on the plug 1 side are electrically connected to each other by means of an interconnecting section 9, earth grounding connected to one of the metallic plates 13 on the socket 2 side and the connection detecting circuit 15 connected to the other metallic plate 13 are short-circuited, and a closed circuit is formed. Therefore, it is detected by the connection detecting circuit 15 that the plug 1 has been connected to the socket 2, and the electric circuit and the like can be controlled. The pushbutton 8 on the plug 1 side is pressed and the engagement section 5 is detached from the engagement section 14 by using the elastic deformation of the metallic plate 4, with the result that the locked state can be released and the connecting section 3 of the plug 1 can be removed from the connecting section 11 of the socket 2.

As described above, according to the above embodiment, when the plug 1 is connected to the socket 2, the engagement section 5 of the metallic plate 4 is engaged with the engagement section 14 of the metallic plate 13 and locked, and a closed circuit is formed. Thus, the connection between the plug 1 and the socket 2 can be detected by means of the connection detecting circuit 15. Since the connector serves as a locking mechanism and as a connection detecting mechanism, a connector which is small in size and low in cost can be obtained.

The section between the metallic plates 13 on the socket 2 side is electrically connected, and one of the metallic plates 4 is grounded to earth and the other metallic plate 4 may be connected to the connection detecting circuit.

As has been explained above, according to the present invention, when the plug is connected to the socket, engagement means of a pair of metallic pieces on the plug are engaged with engagement means of a pair of metallic pieces on the socket and locked, and the metallic pieces can be electrically connected. Either the metallic pieces on the plug or the metallic pieces on the socket are electrically connected to each other. One of the metallic pieces which are not electrically connected to each other is grounded to the earth and the other of the metallic pieces is connected to the connection detecting circuit so as to form a closed circuit. As a result, earth grounding and the connection detecting circuit are short-circuited when the plug is connected to the socket and a closed circuit is formed. Thus the connection can be detected. In this way, since the connector serves both as a locking mechanism for the plug and socket, and as a connection detecting mechanism, an apparatus which is small in size can be obtained at a low cost. In particular, the present invention can be preferably used for portable telephone sets allowing the telephone to be carried on a person or alternatively installed in an automobile and providing a detection means to show when the unit is in service.

Many different embodiments of the present invention may be constructed without departing from the spirit and scope of the present invention. It should be understood that the present invention is not limited to the specific embodiments described in this specification, except as defined in the appended claims.

What is claimed is:

1. A connector comprising:

a plug;

a socket;

connector means having electrical terminals disposed in each of said plug and said socket, whereby electrical signals are transmitted through the electrical terminals when the plug and the socket are connected to each other;

first and second metallic pieces disposed on the plug;

third and fourth metallic pieces disposed on the socket;

connection means for electrically connecting one of (i) said first and second metallic pieces with each other and (ii) said third and fourth metallic pieces with each other;

a connection detecting means for detecting whether one of (i) said first and second metallic pieces and (ii) said third and fourth metallic pieces are electrically connected to one another;

engagement means disposed on said first and second metallic pieces and said third and fourth metallic pieces, said engagement means causing the plug and the socket to be engaged with each other in a locked state when they are connected; and an unlocking means for pressing one of (i) said first and second metallic pieces and (ii) said third and fourth metallic pieces from an outer side of either the plug or the socket to release the plug and the socket from said locked state.

2. The connector as claimed in claim 1, wherein said unlocking means includes a pushbutton.

3. A connection method for a connector, comprising the steps of:

(a) transmitting electrical signals through electrical terminals disposed on each of a plug and a socket when the plug and the socket are connected to each other;

(b) forming a closed circuit loop by connecting first and second metallic pieces, which form an open circuit loop and are disposed on one of the plug and the socket, to third and fourth metallic pieces, respectively, which are disposed on the other of the plug and the socket through connection means for electrically connecting one of (i) the first and second metallic pieces to each other and (ii) the third and fourth metallic pieces to each other when the plug and the socket are connected to each other, said first and second metallic pieces and said third and fourth metallic pieces being locked to each other, respectively, to place the plug and the socket in a locked condition relative to one another by an engagement means;

(c) detecting whether one of (i) said first and second metallic pieces and (ii) said third and fourth metallic pieces are electrically connected to one another; and (d) unlocking said first and second metallic pieces from said third and fourth metallic pieces respectively by pressing one of (i) said first and second metallic pieces and (ii) said third and fourth metallic pieces from an outer side of one of the plug and the socket to release the plug and the socket from said locked condition.

4. A method as in claim 3, wherein step (d) includes pressing a pushbutton to push said one of (i) said first and second metallic pieces and (ii) said third and fourth metallic pieces to release the plug and the socket from said locked condition.

* * * * *